United States Patent [19]

Wang

[11] Patent Number: 4,658,967

[45] Date of Patent: Apr. 21, 1987

[54] EXTENDIBLE RACK ASSEMBLY

[76] Inventor: Shu-San Wang, No. 83, 29 Lane, Hua Cheng Road, Hsin Chuang City, Taipei Hsien, Taiwan

[21] Appl. No.: 793,338

[22] Filed: Oct. 31, 1985

[51] Int. Cl.[4] ..... A47F 5/08

[52] U.S. Cl. ..... 211/94; 211/182

[58] Field of Search ..... 211/94, 175, 59.1, 182; 248/307, 304; 403/292, 298, 297; 24/625, 573

[56] References Cited

U.S. PATENT DOCUMENTS

| | | | |
|---|---|---|---|
| 46,296 | 2/1865 | Colburn | 211/94 |
| 46,751 | 3/1865 | Bradfield | 211/94 |
| 655,739 | 8/1900 | Runtz | 211/94 X |
| 1,995,246 | 3/1935 | Greims | 211/94 |
| 4,068,346 | 1/1978 | Binder | 403/292 X |
| 4,372,450 | 2/1983 | Licari et al. | 248/304 X |

FOREIGN PATENT DOCUMENTS

| | | | |
|---|---|---|---|
| 7600066 | 8/1976 | Netherlands | 211/182 |
| 2116018 | 9/1983 | United Kingdom | 248/307 |

*Primary Examiner*—J. Franklin Foss
*Assistant Examiner*—Sarah A. Lechok Eley
*Attorney, Agent, or Firm*—Cushman, Darby & Cushman

[57] ABSTRACT

The present invention relates to an extendible rack assembly which comprises at least two bars with linking ends, a connector piece with two forked ends for connecting the two bars by engaging with the linking ends of the bars so as to extend the rack, a plurality of hook members with a mounting base, attached to the bars, which hook members are slideable along the extended bars, so that the user can extend the rack to any length needed and the hook members can slide to any location desired along the rack in practical use.

4 Claims, 6 Drawing Figures

EXTENDIBLE RACK ASSEMBLY

BACKGROUND OF THE INVENTION

1. Field of the Invention

The present invention relates to an improved rack, particularly concerning an extendible rack assembly provided with a plurality of hooks which are slideable on the rack assembly.

2. Description of the Prior Art

Many of the known clothes racks used today are designed with either a single hook on a base which is able to stick to a wall or with a bar provided with a predetermined amount of mounted hooks. The former design has the disadvantage that the hook can detach from the wall to which it is stuck if the clothes are too heavy. Although the latter possesses slideable hooks, the number of hooks is limited, the hooks are slideable only along a limited portion of the bar and the rack bar cannot be extended according to the user's need.

SUMMARY OF THE INVENTION

With the above disadvantages in mind, the general object of the invention is to provide an improved rack which is simple in construction and of which the length of the rack bar is adjustable in a long range according to the user's need for his or her practical use.

The other object of the invention is to provide an improved rack including a plurality of slidable hooks according to the user's need which hooks slide any where on the extended rack bar assembly for convenience in practical use.

A still further object of the invention is to provide an improved rack which can be detached into parts for convenient transportation, especially in bulk.

In order to achieve the aforesaid objects as well as other incidental objects and advantages, the invention includes at least two bars, each of which has a pair of ridges extending parallel along one of its sides from one end to the other end. The ridges have two inner faces opposing one another to define a groove.

The invention further includes a flat connector piece for connecting the bars end to end, which has two opposing forked ends to be fitted in the grooves of the bars respectively. Each of the forks of the forked ends consists of a split pin with a recess. The pair of ridges on each of the bars has two flanges projecting inward opposite to each other so as to retain the connector piece in the groove, and two bosses oppositely projecting from the inner faces to engage with the recesses of the split pins. By inserting the connector piece into the groove at the end of one bar and connecting another bar to the connector piece, the rack can be extended to any length desired according to the user's need for practical use.

The invention further includes a hook member, with a base for mounting which has a pair of angled flanges projecting inwardly from the two opposite edges of the base so as to engage slideably with the edges of the bar and allow the hook member to slide along the extended bar assembly.

The invention still further includes an end piece to be attached to one end of the bar, which has a forked end to be fitted in between the end portions of the ridges so that the hook members cannot slide off the bars.

BRIEF DESCRIPTION OF THE DRAWINGS

These and other advantages, objects and features of the present invention will become apparent from the following detailed description of the preferred embodiments with reference to the accompanying drawings, wherein.

DETAILED DESCRIPTION OF THE PREFERRED EMBODIMENT

The following discussion is a detailed description of the best presently contemplated embodiment of the invention. This description is not to be taken in a limiting sense, but is made merely for the purpose of illustrating the general principles of the invention.

Figure 1:
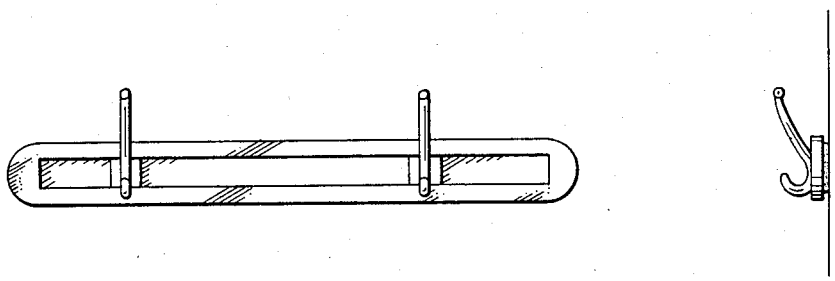
F I G. 1 PRIOR ART
FIG. 1 is a front view of a prior art rack.
Figure 3:
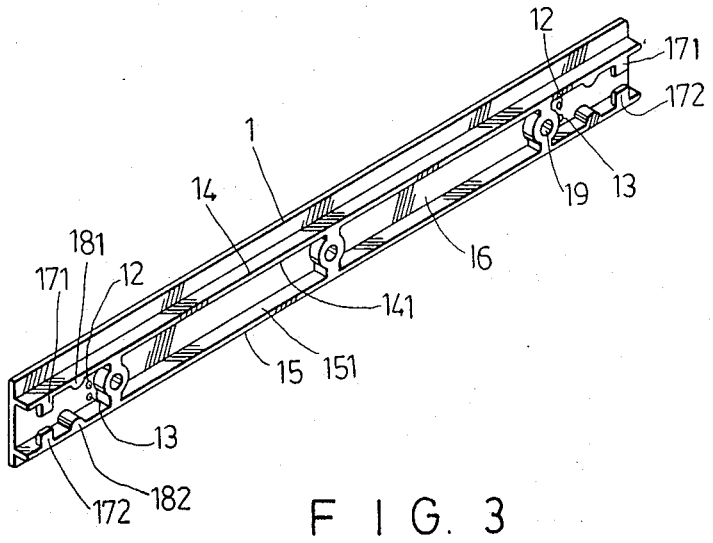
FIG. 3 is a rear view of a bar showing its two ends provided with a portion for engaging a connector.
Figure 2:
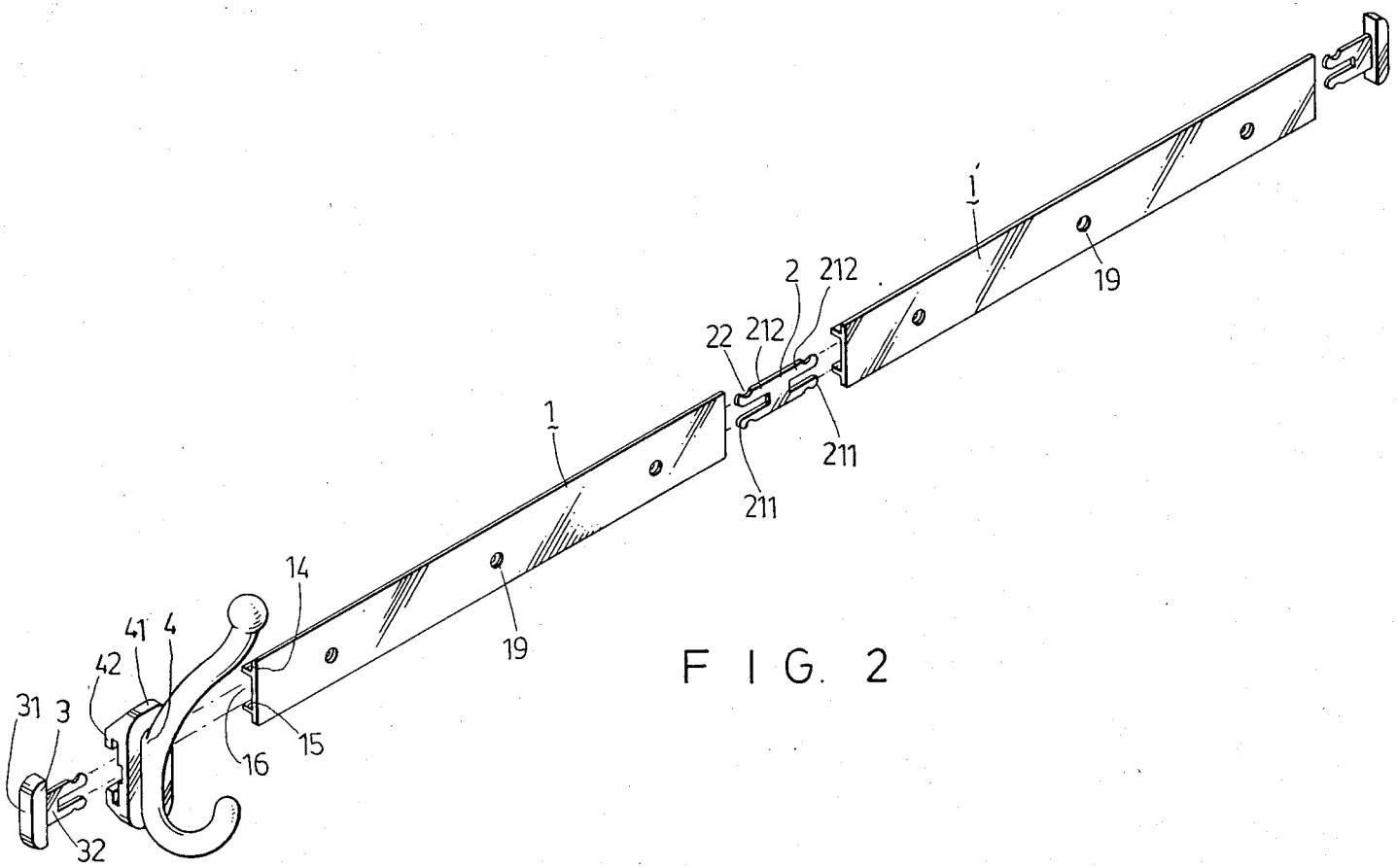
FIG. 2 is an exploded view of a preferred embodiment of the invention.

Referring to FIG. 2, the invention includes at least two bars 1, 1' each of which has a pair of ridges 14, 15 extending parallel along one of its sides from one end to the other end. As shown in FIG. 3, ridges 14, 15 have two respective inner faces 141, 151 opposing one another to define a groove 16.

Figure 4:
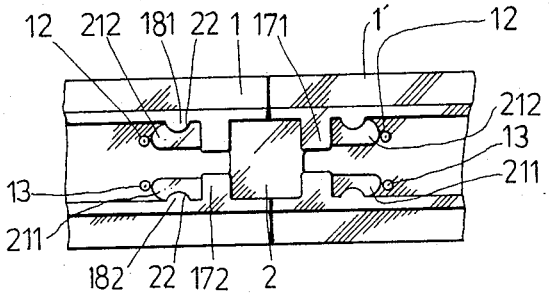
FIG. 4 is an enlarged view of the connecting portion of two adjacent bar ends with a connecting piece in the groove.

As shown in FIG. 2, a flat connector piece 2 for connecting the bars 1, 1' end to end has two opposing forked ends to be fitted in the grooves 16 of the ridges 14, 15 respectively. Each of the forks of the forked ends consists of split pins 211, 212 with a recess 22. The pair of ridges 14, 15 on each of the bars 1, 1' has two flanges 171, 172, shown in FIG. 4, projecting inward opposite to one another so as to retain the connector piece 2 and two bosses 181, 182 which engage with the recesses 22 of the split pins 211, 212. A pair of protrusions 12, 13 are disposed in the groove on the surface of the bar 1, 1' near the two bosses 181, 182 to prevent the connecting piece 2 from slipping farther into the groove 16.

Figure 6:
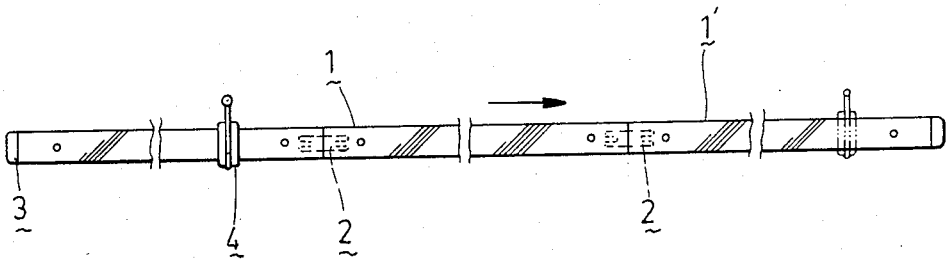
FIG. 6 is a front view of the invention showing that the hook member can slide along the extended bar assembly according to the invention.

As shown in FIG. 2, a hook member 4, with a base 41 for mounting, has a pair of angled flanges 42 projecting inwardly from the two opposite edges of the base so as to engage slideably with the edges of the bar 1 and allow the hook member 4 to slide anywhere along the extended bars, as shown in FIG. 6.

Returning to FIG. 2, an end piece 3 is attached to one end of the bar 1, which has a head portion 31 and a forked end 32, the latter to be fitted in between the end portions of the ridges 14, 15 to prevent the hook member 4 from sliding off the extended bar assembly.

Figure 5:
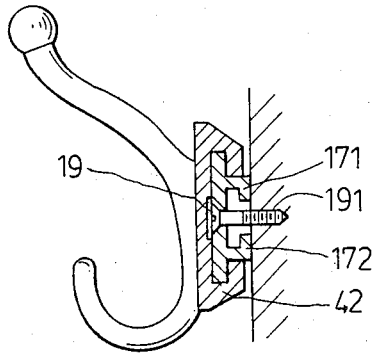
FIG. 5 is a side view of the invention mounted on the wall by a screw or a nail.

There are a plurality of holes 19 disposed on the bar 1, 1' and, as shown in FIG. 5 the rack can be fixed firmly on the wall by a plurality of screws 191 inserted through the holes 19.

While this invention has been described with what are presently considered to be the most practical and preferred embodiments, it is to be understood that the invention is not to be limited to the disclosed embodiments, but on the contrary, is intended to cover various modifications and equivalent arrangements included within the spirit and scope of the appended claims, which scope is to be accorded the broadest interpretation so as to encompass all such modifications and equivalent structures.

I claim:

1. An extendible rack assembly comprising:

a plurality of bars each of which has a pair of edges and a pair of ridges extending parallel along one side of each bar from one end to the other end, said pair of ridges having two inner faces opposing one another to define a groove in each bar;

at least one connector piece for connecting adjacent ones of said bars end to end, said at least one connector piece having two pairs of opposing forked ends fitted in said grooves of said bars respectively, each of said pairs of forked ends consisting of a split pin with a recess;

wherein said pair of ridges on each of said bars has two flanges projecting inwardly opposite to each other from edges of the ridges near ends of each bar, so as to retain said connector piece in said grooves, and two bosses oppositely projecting from said inner faces of the ridges towards each other so as to engage with said recesses of said split pins; and at least one hook member with a base means for mounting said at least one hook member over said bars so that said at least one hook member is slideable along said bars.

2. The extendible rack assembly as recited in claim 1, wherein said base means for mounting of said at least one hook member is a flat piece with a pair of angled flanges projecting inwardly from two opposite edges so as to engage slideably with the pair of edges of said bars.

3. The extendible rack assembly as recited in claim 1, further comprising:

end pieces attached to opposite ends of said bars, each of said end pieces having a forked end fitted in between said ridges at opposite ends of said bars.

4. The extendible rack assembly as recited in claim 1, wherein each bar includes at least one pair of protrusion means, disposed in the groove between each pair of ridges near the two bosses thereof, for preventing said at least one connector piece from slipping farther into the groove.

* * * * *